US007048409B2

(12) United States Patent
Dicken et al.

(10) Patent No.: US 7,048,409 B2
(45) Date of Patent: May 23, 2006

(54) LUMINAIRE

(75) Inventors: Norbert Dicken, Eindhoven (NL); Nicolaas Marinus Fierloos, Geldermalsen (NL); Jelle Hilbrand Schuurmans, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/055,421

(22) Filed: Jan. 22, 2002

(65) Prior Publication Data

US 2002/0172038 A1 Nov. 21, 2002

(30) Foreign Application Priority Data

Jan. 26, 2001 (EP) ..... 01200283

(51) Int. Cl.
*F21S 4/00* (2006.01)

(52) U.S. Cl. ..... 362/217; 362/147; 362/242; 362/224; 362/367; 40/564

(58) Field of Classification Search ..... 362/33, 362/17, 147, 242, 217, 224, 367; 40/575, 40/605, 564
See application file for complete search history.

(56) References Cited

U.S. PATENT DOCUMENTS 2,330,935 A * 10/1943 Tuck
3,460,299 A 8/1969 Wilson ..... 52/144
3,463,914 A * 8/1969 Lutter
4,157,584 A * 6/1979 Bhatt ..... 362/479
4,164,010 A * 8/1979 Finch ..... 362/417
4,293,892 A * 10/1981 Plummer ..... 362/17
4,626,969 A * 12/1986 Kristofek ..... 362/147
5,068,768 A * 11/1991 Kobayashi ..... 362/61
5,161,880 A 11/1992 Azuma ..... 362/223
5,384,658 A * 1/1995 Ohtake et al. ..... 359/707
5,446,634 A * 8/1995 Okubo ..... 362/147
5,669,700 A 9/1997 Wendel ..... 362/223
5,775,799 A * 7/1998 Forkner ..... 362/268
5,934,779 A * 8/1999 Leidig ..... 362/17
5,961,196 A * 10/1999 Long et al. ..... 362/17
6,019,476 A * 2/2000 Kirschner ..... 362/2
6,042,243 A * 3/2000 Grill et al. ..... 362/125
6,400,905 B1 * 6/2002 Tenmyo ..... 396/175
6,655,815 B1 * 12/2003 Sools et al. ..... 362/217

* cited by examiner

*Primary Examiner*—John Anthony Ward
*Assistant Examiner*—Jacob Y. Choi

(57) ABSTRACT

A luminaire (1) or a system of a first luminaire (1) and a second luminaire (11) for lighting an object (V). Each luminaire has a housing (2; 12) provided with a plurality of tubular lamps (3, 3', 3"; 13). The housing (2; 12) has a diffuser (7; 17) positioned in a light emitting window (4; 14) and a side wall (5, 5'; 15), which is orthogonal with respect to the light emitting window (4; 14). In the system, the first and the second luminaire (1; 11) abut one another via the side wall (5, 5'; 15) and/or via the light emitting window (4; 14), wherein an edge (6) of the light emitting window (4) of the first luminaire (1) abuts upon an edge (16) of the light emitting window (14) of the second luminaire (11). The diffusor (7; 17) and the side wall (5, 5'; 15) are made from an optically transparent material. Preferably, the light emitting window (4; 14) is provided with a curtain (21; 31). Preferably, the curtain (21; 31) exhibits a variation in layer thickness, the layer thickness being thicker at a location on the curtain (21; 31) close to the tubular lamps (3, 3', 3"; 13) than farther removed from the tubular lamps (3, 3', 3"; 13). The object (V) is homogeneously and uniformly illuminated by the system.

16 Claims, 1 Drawing Sheet

LUMINAIRE

FIELD OF THE INVENTION

The invention relates to a luminaire for illuminating an object.

The invention further relates to an assembly of a first luminaire and a second luminaire.

The invention further relates to a method of presenting and/or selling an object.

BACKGROUND OF THE INVENTION

Such a luminaire and such an assembly are known per se. They are used inter alia in ceiling lighting for illuminating objects such as, for example, in a shop window, in a shop, in an exhibition space, for example for illuminating artistic objects, or in a showroom, for example for illuminating comparatively large objects, for example motor vehicles. Such an assembly or luminaire is also used for wall illumination so as to illuminate objects sideways, or for floor illumination, for example on stages, for illuminating objects or persons. Furthermore, the assembly and luminaire are used as backlights for, for example, (picture) display devices such as, for example, (PA)LC displays or video walls, and as office lighting or as a luminaire for enhancing the visual appearance of an object. Usually, an assembly as mentioned above comprises a plurality of luminaires mounted next to one another, often in the form of a number of coupled squares.

A luminaire of the type mentioned above has a major drawback. The luminaire has a surface with a non-homogeneous light distribution. As a result of this, the object is not evenly illuminated, which is undesirable.

SUMMARY OF THE INVENTION

The invention has for its object to counteract the above drawback.

According to the invention, this object is achieved by a luminaire for illuminating an object, wherein the luminaire comprises a housing for accommodating at least one tubular lamp, which housing has a light emission window for illuminating the object and a side wall transverse to the light emission window, a diffuser being positioned in the light emission window, and wherein a curtain is provided between the tubular lamp and the diffuser at a distance from the diffuser for obtaining a homogeneous light distribution in at least two stages, with the result that the light emission window shows an evenly illuminated surface.

It was found that the light emission window shows an evenly illuminated surface during operation of the lamp. The expression "evenly illuminated" in the description of the present invention means that the light emission window during operation has a light distribution over the surface of the light emission window which shows differences in intensity which are not or substantially not observable to the human eye. In other words, the light output of a light emission window has a dependence on the position on the light emission window which is not or substantially not observable.

Light emitted by the tubular lamps during operation reaches the light emission window of the luminaire and is emitted there in the direction of the object. Such a luminaire usually comprises a plurality of tubular lamps, for example low-pressure mercury vapor discharge lamps. These light sources are usually distributed in a certain regular arrangement in the housing, such that the tubular lamps are positioned, for example, parallel to one another.

The inventors have recognized that a light homogenization in two stages contributes to a very homogeneous distribution of the intensity of the light issuing from the light emission window, rendering the contours of the tubular lamps at least substantially invisible to an observer. The curtain divides an internal space in the luminaire into a first and a second chamber. A first homogenization of light is achieved in the first chamber and during the passage of the light through the curtain. Preferably, the curtain has a light transmission variation by which a yet further homogenization of the light issuing from the light emission window can be achieved, the transmittance to light of the curtain being chosen to be smaller directly opposite a location where the tubular lamp is present during operation than farther removed from the lamp. The curtain may be, for example, a woven gauze with a variation in its mesh width, the mesh width being chosen to be comparatively small directly opposite the location where the tubular lamp is present during operation as compared with locations farther removed from the lamp. Preferably, however, the curtain is a layer having a variation in its layer thickness, which can usually be provided in a comparatively simple and inexpensive manner. The layer thickness of the curtain is chosen to be greater directly opposite the location where the tubular lamp is present during operation than farther removed from the lamp. A curtain which is comparatively thick in locations on the light emission window closely adjacent the tubular lamp and comparatively thin in locations on the light emission window comparatively farther removed from the tubular lamp or lamps achieves a comparatively high uniformity of the distribution of the light intensity of the light issuing through the curtain from the first chamber during operation. The light coming from the first chamber enters the second chamber, where subsequently the light is further homogenized owing to reflection of the light in the second chamber and owing to the passage of the light through the diffuser, before the light is emitted through the light emission window. The homogenization of light in two stages owing to, inter alia, the curtain and the diffuser provided in the light emission window renders it possible to position the tubular lamps close to the curtain and accordingly to the light emission window, with the result that the dimensions of the luminaire are more compact than those of the known luminaire, while nevertheless a more even light distribution is realized than with the known luminaire. This renders it possible to reduce the depth of the housing substantially, which is a major advantage in mounting the assembly.

Preferably, the transmittance of the curtain where the layer thickness is greatest amounts to approximately 50% of the transmittance of the curtain where the layer thickness is smallest. In other words, the transmittance of the curtain on the light emission window directly opposite the location where the tubular lamp is present during operation amounts to approximately 50% of the transmittance of the curtain at the area of the light emission window where the tubular lamp is at a maximum distance from the light emission window during operation. Particularly suitable materials for the curtain are reflecting and/or light-scattering materials such as calcium halophosphate and/or calcium pyrophosphate. Such a curtain is preferably provided in the form of a paint to which a binder, for example a fluoro-copolymer enabling the omission of an otherwise necessarily separate baking out step of the curtain, is added on a carrier, for example a carrier manufactured from transparent glass, synthetic resin, or perspex. The diffuser is manufactured, for example, from a glass or from a synthetic resin by which the light is diffusely scattered.

An assembly of known luminaires has the disadvantage that a comparatively wide, comparatively dark band is present between the luminaires in the assembly of a first luminaire and a second luminaire. This disadvantage is counteracted by an assembly of a first luminaire and a second luminaire according to the invention for illuminating an object.

In this case, the first luminaire lies against the second luminaire with respective side walls, while the edge of the light emission window of the first luminaire lies against an edge of a light emission window of the second luminaire in the assembly of the first and the second luminaire, and the light emission windows and the side walls are manufactured from a light-transmitting material.

It was found that the light emission windows together form an evenly illuminated surface during operation of the lamp. The expression "evenly illuminated" in the description of the present invention means that the light emission window has a light distribution over the surface of the light emission window during operation which shows differences in intensity which are not or substantially not observable to the human eye. Furthermore, the expression "evenly illuminated" in relation to the assembly means that especially the edges of the respective light emission windows and transitions between mutually adjoining luminaires show differences in light intensity with respect to the light emitted by the relevant light emission window as a whole which are not or substantially not observable. In other words, the light output of a light emission window, including its edge, shows a dependence on the position on the light emission window which is not or substantially not observable. The assembly is built up in such a way that the light emission windows of mutually adjoining luminaires touch one another or at least substantially touch one another, whereby a comparatively wide, comparatively dark band at the area of contact of the mutually adjoining luminaires, as present in the known assembly, is avoided. Since the side wall of the luminaire is manufactured from an optically transparent material, light emitted by the tubular lamps during operation is partly caught by this side wall, the light thus caught being transported by internal reflections in the direction of the light emission window, where it is emitted again. This achieves that the edge of the light emission window of the first luminaire has a luminous intensity, which is at least substantially equal to that of the rest of the light emission window. In a situation with two or more luminaires adjoining one another in the assembly at the areas of the edges of the light emission windows of the respective luminaires, a light emission window is obtained thereby which is evenly illuminated up to and including the edge of the light emission window during operation, such that the assembly emits a uniform light. An observer will not or substantially not be capable of distinguishing the edges of the light emission windows of the respective luminaires on the basis of the light distribution as emitted by the assembly during operation.

The luminaires usually do not lie against one another in the known assembly of luminaires, so that a comparatively wide, dark band is present and observed between the luminaires. These bands achieve that the known assembly has a checkered appearance and that in addition the object is not evenly illuminated. Since the object is integrally and evenly illuminated thanks to the measure according to the invention, an observer's attention is not diverted from the object by irregularities in the illumination of the object. The use of the assembly according to the invention renders it possible to illuminate objects very homogeneously and uniformly. This has special advantages for viewing, for example, artistic objects in museums or motor vehicles, for example in showrooms of garages. The absence of visible edges in the assembly is perceived to be an advantage in its reflection on the object, especially in the case of objects having reflecting properties, preferably objects having specular reflection. The measure according to the invention enhances the attractiveness of objects presented, for example, with the purpose of selling the objects.

The patent application EP 99203849.7 not previously published describes a luminaire for illuminating an object, wherein the luminaire comprises a housing for accommodating at least one tubular lamp, which housing has a light emission window for illuminating the object and a side wall transverse to the light emission window, while a diffuser is positioned in the light emission window, the diffuser having a layer thickness variation such that the layer thickness of the diffuser is chosen to be greater opposite a location where the tubular lamp is present during operation than farther removed from the lamp. To achieve that the light emission window forms an acceptable, homogeneously illuminated surface, a large difference in layer thickness is required between the location directly opposite the tubular lamp and a location farther removed from the lamp. Contours of the tubular lamp, however, are visible as small differences in light intensity when viewed at an angle to the optical axis and transverse to the longitudinal direction of the tubular lamp. These contours are more clearly visible from locations where a virtual line between an observer and the tubular lamp intersects the diffuser in a location where the diffuser has a comparatively small layer thickness.

BRIEF DESCRIPTION OF THE DRAWING

The invention will now be described in more detail with reference to a number of embodiments and a drawing, in which.

Figure 1:
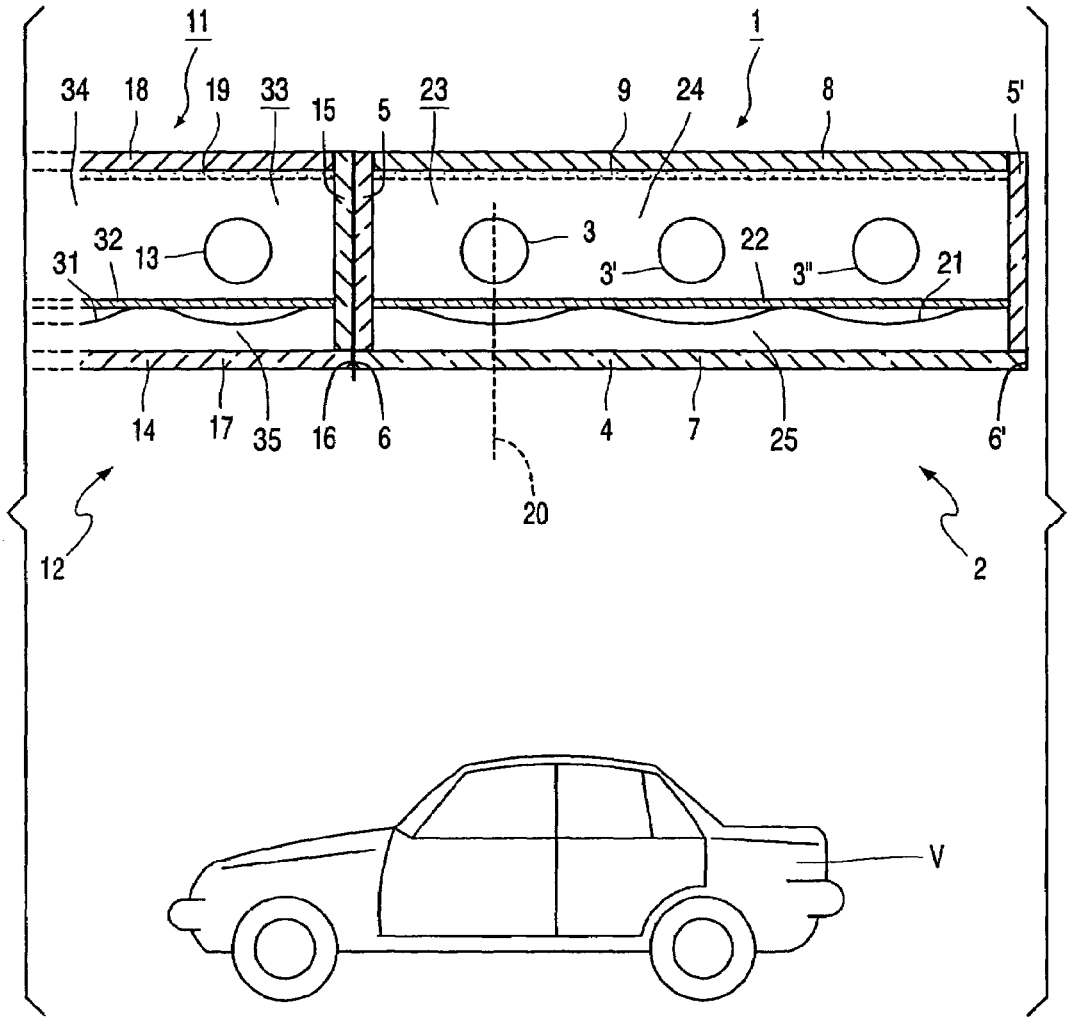
FIG. 1 shows an example of an assembly of two luminaires according to the invention in cross-section.

The FIGURE is purely diagrammatic and not drawn true to scale. Some dimensions are particularly strongly exaggerated for the sake of clarity.

DETAILED DESCRIPTION OF PRESENTLY PREFERRED EMBODIMENTS

FIG. 1 shows an assembly of a first luminaire 1 and a second luminaire 11 for illuminating an object V. The object V in FIG. 1 is a motor vehicle, for example an automobile. Alternative objects are artistic objects, such as paintings, photographs, sculptures, etc. Such objects often have a mirroring surface.

The first and the second luminaire 1; 11 each comprise a box-type housing 2; 12. A plurality of tubular lamps 3, 3', 3"; 13 is provided in the housing 2; 12, for example low-pressure mercury vapor discharge lamps. Three discharge lamps of the TL5 type are placed in the luminaire 1 in the example of FIG. 1. In an alternative embodiment, five, eight, or more lamps are provided in one luminaire, for example of the TL5 28 W type with color rendering index 84. The tubular lamps 3, 3', 3"; 13 are provided in the housing 2; 12 in a certain regular arrangement, such that the tubular lamps 3, 3', 3"; 13 are positioned parallel to one another. Preferably, the distance to the side wall 5; 15 of the lamp 3; 13 placed closest to the side wall 5; 15 is at least substantially equal to half the mutual interspacings between the lamps 3, 3', 3".

Each of the housings 2; 12 of the luminaires 1; 11 is provided with a curtain 21; 31 and with an optically transparent diffuser 7; 17 in a light emission window 4; 14 for the purpose of reducing the direct view of the tubular lamps 3, 3', 3"; 13 in the housing 2; 12 and obtaining a uniform light output. The housing is provided with a side wall 5, 5'; 15 transverse to the light emission window 4; 14. If so desired, the side wall 5, 5'; 15 may alternatively be provided so as to be oblique with respect to the light emission window 4; 14. The curtain 21; 31 is manufactured, for example, from light-reflecting powders, for example calcium halophosphate and/or calcium pyrophosphate, which powders are provided on a carrier 22; 32 of a transparent material such as glass, synthetic resin, or perspex. The diffuser 7; 17 and the side wall 5, 5'; 15 are manufactured, for example, from a glass, a synthetic resin, or perspex, which materials scatter the light diffusely (for example, so-called milk glass).

The first luminaire 1 in the assembly according to the invention lies with a side wall 5, against the wall 15 of the second luminaire 11. In an alternative embodiment, the luminaires 1; 11 lie against one another via the diffusers 7; 17 in the assembly. In that case the side walls support the diffusers 7; 17 not at the edge of the light emission window but, for example, at a certain (short) distance from the edge of the light emission window. In a further alternative embodiment of the assembly, the light emission window is interrupted at the area of the side wall. In that case, the edge of the side wall is presumed to form part of the light emission window in the description of this invention.

In the example of FIG. 1, both the housing 2 of the first luminaire 1 and the housing 12 of the second luminaire 11 are provided with a side wall, denoted 5 and 15, respectively, at the area where the luminaires 1; 11 make contact. The invention, however, is not limited to this embodiment. Thus it is possible for only one side wall to be present at the area of contact of the adjoining luminaires, in which case, for example, the side wall of the one luminaire supports the light emission windows of both luminaires. Such an embodiment may simplify the mounting of luminaires in the formation of the assembly. In the assembly according to the invention, an edge 6, 6' of the light emission window 4 of the first luminaire 1 situated at the area of the side wall 5, 5' lies against an edge 16 of the light emission window 14 of the second luminaire 11 situated at the area of the side wall 15. Furthermore, the diffusers 7; 17 and the side walls 5, 5'; 15 are manufactured from an optically transparent material. The two light emission windows 4; 14 form an evenly illuminated surface in such an assembly.

In the example of FIG. 1, the curtain 21; 31 is provided in an internal space 23; 33 of the luminaire 1; 11 at a distance both from the tubular lamps 3, 3', 3"; 13 and from the diffuser 7; 17 in the housing. The internal space 23; 33 is subdivided into a first 24; 34 and a second chamber 25; 35 by the curtain 21; 31. The curtain 21; 31 in particular shows a variation in layer thickness, the layer thickness of the curtain 21; 31 being chosen to be greater directly opposite the location where the tubular lamp 3, 3', 3"; 13 is present during operation. A longitudinal axis 20 transverse to the light emission window 4 is shown in FIG. 1, which axis passes through the center of the tubular lamp 3 and indicates the thickest portion of the curtain 21; 31. The subdivision of the internal space 23; 33 into the first 24; 34 and the second chamber 25; 35 leads to a light homogenization in two stages, which contributes to a very homogeneous distribution of the intensity of the light issuing from the light emission window 4; 14 and which renders contours of the tubular lamps 3, 3', 3"; 13 at least substantially invisible to an observer. A first light homogenization is achieved in the first chamber 24; 34 and during the passage of the light through the curtain 21; 31. The curtain 21; 31 shown achieves a comparatively high uniformity of the distribution of the light intensity of the light issuing through the curtain 21; 31 and from the first chamber 24; 34 during operation. The light issuing from the first chamber 24; 34 enters the second chamber 25; 35, where subsequently a further light homogenization takes place through reflection of the light in the second chamber 25; 35 and owing to the passage of the light through the diffuser 7; 17, before the light is emitted by the light emission window 4; 14.

The provision of a curtain 21; 31 with the layer thickness variation in the light emission window of the luminaire 1; 11 renders it possible to position the tubular lamp 3, 3', 3"; 13 comparatively close to the curtain 21; 31 and the light emission window 4; 14 in the housing 2; 12, so that the dimensions of the luminaire 1; 11 are more compact than those of the known luminaire, while nevertheless a more uniform light distribution is realized than with the known luminaire. It is rendered possible thereby in particular to reduce the depth of the housing 2; 12 considerably, which is an advantage in mounting of the assembly.

The housing 2; 12 of each luminaire 1; 11 in the assembly is preferably rectangular, for example square, with typical dimensions being 300 mm, 600 mm, 900 mm, 1200 mm, or 1500 mm, or combinations thereof. A particularly suitable height for the housing 2; 12 is 40 to 80 mm, in particular a height of 45 mm. The possibility of a compact construction means that no special recessed panels need be used in ceiling mounting. In fact, the luminaires are provided with mutual interspacings equal to zero and form as it were an integral whole in the assembly. The components necessary for fastening are invisible. It is possible for maintenance purposes to remove the diffuser 7; 17 from the housing in a direction parallel to the longitudinal axis 20, for example for the replacement of the tubular lamps.

The transmittance of the curtain 21; 31 at the area where the layer thickness is greatest preferably amounts to approximately 50% of the transmittance of the curtain 21; 31 at the area where the layer thickness is smallest. In other words, the transmittance of the curtain 21; 31 directly opposite the location where the tubular lamp 3, 3', 3"; 13 is present during operation is approximately 50% of the transmittance of the curtain 21; 31 where the tubular lamp 3, 3', 3"; 13 is at a maximum distance during operation. Particularly suitable materials for the curtain 21; 31 are calcium halophosphate and/or calcium pyrophosphate. Such a curtain is provided on the carrier 22; 32 in the form of a paint, for which a binder, for example a fluoro-copolymer, for example THV, is used, as well as a solvent (for example Mibk). The carrier material used for the carrier 22; 32 may be glass, synthetic resin, and perspex. The advantages of the use of such a curtain 21; 31 and such a binder in the curtain 21; 31 are that baking out is not necessary, and that the reflection has at least substantially the same high value over the entire visible range and over a major portion of the UV range. This means that this curtain 21; 31 and these binders are particularly suitable for use in coating layers against which the light is reflected many times, because selective absorption and resulting color differences are effectively counteracted thereby. Further additives may be added to the paint mixture, for example those that exhibit an improved flow or mixing behavior.

The light absorption for visible light of such a curtain 21; 31 is very low, i.e., below 3%. In addition, a curtain 21; 31 comprising calcium halophosphate and/or calcium pyrophosphate shows substantially no color shift, i.e., such a curtain has a comparatively small wavelength dependence.

The housing 2; 12 in the example of FIG. 1 is further provided with a rear wall 8; 18 which is provided at a side facing the light emission window 4; 14 and has a reflecting coating 9; 19 which is known per se.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A luminaire for illuminating an object, said luminaire comprising:

a first chamber for accommodating at least one tubular lamp; and a second chamber defined by a light emission window, a curtain, and a light transmitting side wall, wherein, when that at least one tubular lamp is located within said first chamber, at least a portion of any light emitted by the at least one tubular lamp passes through said curtain into said second chamber with a first homogenous light distribution, and wherein at least a portion of the at least a portion of any light emitted by the at least one tubular lamp passing into said second chamber passes through said light emitting window with a second homogenous light distribution.

2. The luminaire of claim 1, wherein said curtain includes a calcium halophosphate material.

3. The luminaire of claim 1, wherein said curtain includes a calcium pyrophosphate material.

4. The luminaire of claim 1, wherein said curtain includes a fluoro-copolymer serving as a binder.

5. The luminaire of claim 1, wherein said curtain has a layer thickness variation; and wherein a light transmittance of said curtain is a function of the layer thickness variation of said curtain.

6. A luminaire for illuminating an object, said luminaire comprising:

a first chamber for accommodating at least one tubular lamp: and a second chamber defined by a light emission window and a carrier wall; and a curtain disposed within said second chamber and affixed to the carrier wall, wherein, when the at least one tubular lamp is located within said first chamber, at least a portion of any light emitted by the at least one tubular lamp passes through said carrier wall into said second chamber with a first homogenous light distribution, wherein at least a portion of the at least a portion of any light emitted by the at least one tubular lamp passing into said second chamber passes through said light emitting window with a second homogenous light distribution.

7. The luminaire of claim 6, wherein said curtain has a layer thickness variation; and wherein a light transmittance of said curtain is a function of the layer thickness variation of said curtain.

8. The luminaire of claim 6, wherein said second chamber is further defined by a side wall including a light-transmitting material.

9. The luminaire of claim 6, wherein said curtain includes a calcium halophosphate material.

10. The luminaire of claim 6, wherein said curtain includes a calcium pyrophosphate material.

11. The luminaire of claim 6, wherein said curtain includes a fluoro-copolymer serving as a binder.

12. A lighting system for illuminating an object, said lighting system comprising:

a first luminaire including a first homogenous light distribution chamber and a second homogenous light distribution chamber both defined by a first side wall, said second homogenous light distribution chamber further defined by a first light emission window;

a second luminaire including a third homogenous light distribution chamber and a fourth homogenous light distribution chamber both defined by a second side wall, said fourth homogenous light distribution chamber further defined by a second light emission window;

wherein a first edge of said first light emission window lies against a second edge of said second light emission window; and wherein said first side wall and said second side wall both include a light-transmitting material.

13. The lighting system of claim 12, wherein said first side wall abuts said second side wall.

14. The lighting system of claim 12, wherein said first side wall and said second side wall are integrated to form one side wall.

15. The lighting system of claim 12, wherein said first luminaire includes a curtain disposed within said second homogenous light distribution chamber;

wherein, when at least one tubular lamp is located within said first homogenous light distribution chamber, at least a portion of any light emitted by the at least one tubular lamp passes through said curtain into said second homogenous light distribution chamber with a first homogenous light distribution; and wherein at least a portion of the at least a portion of any light emitted by the at least one tubular lamp passing into said second homogenous light distribution chamber passes through said first light emitting window with a second homogenous light distribution.

16. The lighting system of claim 12, wherein said second homogenous light distribution chamber is further defined by a carrier wall;

wherein, when at least one tubular lamp is located within said first homogenous light distribution chamber, at least a portion of any light emitted by the at least one tubular lamp passes through said carrier wall into said second homogenous light distribution chamber with a first homogenous light distribution; and wherein at least a portion of the at least a portion of any light emitted by the at least one tubular lamp passing into said second homogenous light distribution chamber passes through said first light emitting window with a second homogenous light distribution.

* * * * *